US009073560B2

(12) United States Patent
Fanara et al.

(10) Patent No.: US 9,073,560 B2
(45) Date of Patent: Jul. 7, 2015

(54) SYSTEM AND METHOD FOR DETERMINING COMMUNICATION PATHS IN A TRAINLINE COMMUNICATION NETWORK

(71) Applicants: Electro-Motive Diesel, Inc., La Grange, IL (US); Secure Communications Systems Inc., Santa Ana, CA (US)

(72) Inventors: Mark Alan Fanara, Blue Springs, MO (US); James Robert Luecke, Buckeye, AZ (US)

(73) Assignees: Electro-Motive Diesel, Inc., LaGrange, IL (US); Secure Communications Systems Inc., Santa Ana, CA (US)

( * ) Notice: Subject to any disclaimer, the term of this patent is extended or adjusted under 35 U.S.C. 154(b) by 12 days.

(21) Appl. No.: 13/974,723

(22) Filed: Aug. 23, 2013

(65) Prior Publication Data

US 2015/0057846 A1 Feb. 26, 2015

(51) Int. Cl.
*B61L 15/00* (2006.01)

(52) U.S. Cl.
CPC ..... *B61L 15/0018* (2013.01); *B61L 15/0072* (2013.01)

(58) Field of Classification Search
CPC .. H04B 7/2659; H04B 7/264; B61L 15/0072; B61L 15/0018; B61C 17/12
USPC ..... 701/19; 370/226
See application file for complete search history.

(56) References Cited

U.S. PATENT DOCUMENTS 4,556,866 A 12/1985 Gorecki
4,815,106 A 3/1989 Propp et al.
4,860,308 A 8/1989 Kamerman et al.
5,351,272 A 9/1994 Abraham
5,446,918 A 8/1995 Lamy
5,651,517 A 7/1997 Stevens et al.

(Continued)

FOREIGN PATENT DOCUMENTS

DE 195 01 887 7/1995
DE 100 44 088 4/2002

(Continued)

OTHER PUBLICATIONS

Amirshahi, Pouyan, et al., "High-Frequency Characteristics of Overhead Multiconductor Power Lines for Broadband Communications," IEEE Journal on Selected Areas in Communications, vol. 24, No. 7, Jul. 2006, p. 1292.

(Continued)

*Primary Examiner* — John Q Nguyen
*Assistant Examiner* — Nadeem Odeh
(74) *Attorney, Agent, or Firm* — Finnegan, Henderson, Farabow, Garrett & Dunner, LLP

(57) ABSTRACT

A system for determining communication paths in a trainline communication network utilized by a consist has a processor configured to determine direct data transmission metrics for one locomotive of the consist. The processor receives direct data transmission metrics for the remaining locomotives of the consist and determines indirect data transmission estimates for the one locomotive based on the received direct data transmission metrics. The processor determines communication paths for the one locomotive by comparing the direct data transmission metrics for the one locomotive to the indirect data transmission estimates for the one locomotive.

17 Claims, 3 Drawing Sheets

(56) References Cited

U.S. PATENT DOCUMENTS

| | | | | |
|---|---|---|---|---|
| 5,706,191 | A | 1/1998 | Bassett et al. | |
| 5,717,685 | A | 2/1998 | Abraham | |
| 5,777,545 | A | 7/1998 | Patel et al. | |
| 5,777,547 | A | 7/1998 | Waldrop | |
| 5,818,127 | A | 10/1998 | Abraham | |
| 5,969,643 | A | 10/1999 | Curtis | |
| 5,986,577 | A | 11/1999 | Bezos | |
| 6,114,974 | A | 9/2000 | Halvorson | |
| 6,163,089 | A | 12/2000 | Kull | |
| 6,373,375 | B1 | 4/2002 | Hoetzel et al. | |
| 6,392,368 | B1 | 5/2002 | Deller et al. | |
| 6,408,766 | B1 | 6/2002 | McLaughlin et al. | |
| 6,421,587 | B2 | 7/2002 | Diana et al. | |
| 6,442,195 | B1 | 8/2002 | Liu et al. | |
| 6,490,523 | B2 | 12/2002 | Doner | |
| 6,587,739 | B1 | 7/2003 | Abrams et al. | |
| 6,595,045 | B1 | 7/2003 | Fuglewicz et al. | |
| 6,862,502 | B2 * | 3/2005 | Peltz et al. | 701/19 |
| 6,972,670 | B2 | 12/2005 | LaDuc et al. | |
| 6,995,658 | B2 | 2/2006 | Tustison et al. | |
| 7,006,523 | B2 | 2/2006 | Binder | |
| 7,021,588 | B2 | 4/2006 | Hess, Jr. et al. | |
| 7,182,411 | B2 | 2/2007 | Levy et al. | |
| 7,206,320 | B2 | 4/2007 | Iwamura | |
| 7,336,156 | B2 | 2/2008 | Arita et al. | |
| 7,893,557 | B2 | 2/2011 | Davis et al. | |
| 8,532,850 | B2 * | 9/2013 | Cooper et al. | 701/19 |
| 2002/0011923 | A1 | 1/2002 | Cunningham et al. | |
| 2002/0101882 | A1 | 8/2002 | Kim | |
| 2002/0167398 | A1 | 11/2002 | Strasser | |
| 2003/0094546 | A1 * | 5/2003 | Kellner et al. | 246/167 R |
| 2003/0195668 | A1 | 10/2003 | Radtke et al. | |
| 2003/0214417 | A1 * | 11/2003 | Peltz et al. | 340/825 |
| 2004/0223275 | A1 | 11/2004 | Yanagida et al. | |
| 2004/0261101 | A1 | 12/2004 | Iwamura | |
| 2005/0013320 | A1 | 1/2005 | Binder | |
| 2005/0085259 | A1 | 4/2005 | Conner et al. | |
| 2005/0143868 | A1 | 6/2005 | Whelan | |
| 2006/0025903 | A1 | 2/2006 | Kumar | |
| 2006/0170285 | A1 | 8/2006 | Morimitsu et al. | |
| 2007/0282494 | A1 | 12/2007 | Moffitt et al. | |
| 2007/0286079 | A1 | 12/2007 | Mollenkopf et al. | |
| 2008/0195259 | A1 | 8/2008 | Davis et al. | |
| 2008/0211663 | A1 | 9/2008 | Mansfield et al. | |
| 2008/0298384 | A1 | 12/2008 | Beaucage | |
| 2009/0042436 | A1 | 2/2009 | Emoto et al. | |
| 2010/0045447 | A1 | 2/2010 | Mollenkopf et al. | |
| 2010/0235022 | A1 | 9/2010 | Siddappa et al. | |
| 2010/0241295 | A1 | 9/2010 | Cooper et al. | |
| 2010/0256842 | A1 | 10/2010 | Liberatore | |
| 2011/0051642 | A1 * | 3/2011 | Krishnaswamy | 370/311 |
| 2011/0093144 | A1 | 4/2011 | Goodermuth et al. | |
| 2011/0251742 | A1 * | 10/2011 | Haas et al. | 701/19 |
| 2012/0163201 | A1 | 6/2012 | Williams et al. | |
| 2013/0157703 | A1 * | 6/2013 | Jain | 455/500 |
| 2013/0297163 | A1 * | 11/2013 | Kull | 701/70 |

FOREIGN PATENT DOCUMENTS

| | | |
|---|---|---|
| DE | 202007008825 | 8/2007 |
| EP | 0 968 897 | 1/2000 |
| EP | 1 010 602 | 6/2000 |
| EP | 1 065 127 | 1/2001 |
| EP | 1 253 725 | 10/2002 |
| EP | 1 306 283 | 5/2003 |
| EP | 1 487 128 | 12/2004 |
| GB | 2 450 520 | 12/2008 |
| JP | 07/508609 | 9/1995 |
| JP | 11/317697 | 11/1999 |
| JP | 2004/235752 | 8/2004 |
| JP | 2004/241997 | 6/2005 |
| JP | 2005/176131 | 6/2005 |
| WO | WO 94/01949 | 1/1994 |
| WO | WO 2004/054224 | 6/2004 |
| WO | WO 2006/075767 A3 | 7/2006 |

OTHER PUBLICATIONS

Carcelle, Xavier, "Power Line Communications in Practice," Hybrid PLC (2009), p. 304.

Dai, Huaiyu, et al., "Advanced Signal Processing for Power Line Communications," *IEEE Communications Magazine*, May 2003, p. 100.

Hailes, S., "Modern telecommunications systems for train control," The 11th IET Professional Development Course on Railway Signalling and Control Systems, Jun. 2006, pp. 185-192.

IEEE Standard for Communications Protocol Aboard Trains, IEEE Std 1473-1999.

Kamata, Keiichi, "T-Ethernet: The Next International Standard Candidate for Train Communication Network." 2008.

Kirrmann, Hubert, et al., "The IEC/IEEE Train Communication Network," IEEE (2001).

Latchman, Haniph A., et al., "Homeplug AV and IEEE 1901: A Handbook for PLC Designers and Users," IEEE Press, p. 316.

Liu, Er, et al., "Broadband Powerline Channel and Capacity Analysis," IEEE (2005) p. 7.

Liu, Er, et al., "Powerline Communication Over Special Systems," IEEE (2005), p. 167.

"Nexans signaling cable enhances," *Railway Gazette International*; Apr. 2006; 162, 4; ProQuest, p. 206.

PM4380 Analog Front End for VDSL2/ADSL2+, Preliminary Product Brief, PMC-2060187, Issue 3, PMC-Sierra, Inc. (2007).

Roden, Andrew, "Duotrack signals S&T cabling revolution," *International Railway Journal*; Jul. 2007; 47, 7; ABI/INFORM Complete, p. 38.

Russo, D., et al., "A New Approach for Train Passenger Information Systems," presented at WCRR 2008 Seoul Korea, May 18-22, 2008.

Swanson, John D., "Advanced Light Rail Vehicle Communication Systems Design," Proceedings of the 2004 ASME/IEEE Joint Rail Conference, Apr. 6-8, 2004, p. 213.

Trainline communications—trainline communication system specifications—Vehicle Track Systems Newletter, *Railway Age*, Dec. 1994.

U.S. Appl. No. 13/563,220 by Aaron Gamache Foege et al., filed Jul. 31, 2012, entitled "Fuel Distribution System for Multi-Locomotive Consist".

U.S. Appl. No. 13/690,239 by James Robert Luecke et al., filed Nov. 30, 2012, entitled "Data Communication Systems and Methods for Locomotive Consists".

U.S. Appl. No. 13/903,367 by Tom Otsubo et al., filed May 24, 2013, entitled "Communication System for Use with Train Consist".

U.S. Appl. No. 13/903,395 by Tom Otsubo et al., filed May 24, 2013 entitled "Locomotive/Tender Car Communication System".

* cited by examiner

SYSTEM AND METHOD FOR DETERMINING COMMUNICATION PATHS IN A TRAINLINE COMMUNICATION NETWORK

TECHNICAL FIELD

The present disclosure relates generally to a trainline communication network, and more particularly, to a system and method for determining communication paths in a trainline communication network.

BACKGROUND

A consist includes one or more locomotives that are coupled together to produce motive power for a train of rail vehicles. The locomotives each include one or more engines, which combust fuel to produce mechanical power. The engine (s) of each locomotive can be supplied with liquid fuel (e.g., diesel fuel) from an onboard tank, gaseous fuel (e.g., natural gas) from a tender car, or a blend of the liquid and gaseous fuels. The mechanical power produced by the combustion process is directed through a generator and used to generate electricity. The electricity is then routed to traction motors of the locomotives, thereby generating torque that propels the train. The locomotives can be connected together at the front of the train or separated and located at different positions along the train. For example, the consist can be positioned at the front, middle, or end of the train. In some instances, more than one consist can be included within a single train. The locomotives in a consist can be oriented in a forward-facing (or "long hood") direction or a backward-facing (or "short hood") direction. In some consists, the locomotives include computer systems for maintaining operations of the locomotive. These computer systems are sometimes disposed on the long hood side of the locomotive.

Because the locomotives of a consist must cooperate to propel the train, communication between the locomotives can be important. Historically, this communication has been facilitated through the use of an MU (Multi-Unit) cable that extends along the length of the consist. An MU cable is comprised of many different wires, each capable of carrying a discrete signal used to regulate a different aspect of consist operation. For example, a lead locomotive generates current within a particular one of the wires to indicate a power level setting requested by the train operator. When this wire is energized, the engines of all trail locomotives are caused to operate at a specific throttle value. In another example, when one locomotive experiences a fault condition, another of the wires is energized to alert the other locomotives of the condition's existence.

Although acceptable in some applications, the information traditionally transmitted via the MU cable may be insufficient in other applications. For example, during the fault condition described above, it can be important to know a severity and/or cause of the fault condition so that an appropriate response to the fault condition can be implemented in an effective and efficient manner. Additionally, as consist configurations become more complex, for example during multi-unit blended fuel operations (i.e., operations where gaseous fuel from a tender car is simultaneously supplied to multiple locomotives and mixed with diesel fuel at different rates), control of the locomotives and/or the tender car may require a greater amount of cooperation and/or more complex communication than can be provided via the MU cable.

One attempt to address the above-described problems is disclosed in U.S. Patent Publication 2010/0241295 of Cooper et al. that published on Sep. 23, 2010 ("the '295 publication").

Specifically, the '295 publication discloses a consist having a lead locomotive and one or more trail locomotives connected to each other via an MU cable. Each locomotive includes a computer unit, which, along with the MU cable, forms an Ethernet network in the train. With this configuration, network data can be transmitted from the computer unit in the lead locomotive to the computer units in the trail locomotives. The network data includes data that is packaged in packet form as data packets and uniquely addressed to particular computer units. The network data can be vehicle sensor data indicative of vehicle health, commodity condition data, temperature data, weight data, and security data. The network data is transmitted orthogonal to conventional non-network (i.e., command) data that is already being transmitted on the MU cable.

While the consist of the '295 publication may have improved communication between locomotives, it may still be less than optimal. In particular, the topology of the trainline communication network of the '295 publication does not provide indirect communication between locomotives, which can lead to poor overall network performance in some cases.

The system of the present disclosure solves one or more of the problems set forth above and/or other problems with existing technologies.

SUMMARY

In one aspect, the present disclosure is directed to a system for determining communication paths in a trainline communication network utilized by a consist including a processor configured to determine direct data transmission metrics for one locomotive of the consist. The processor receives direct data transmission metrics for the remaining locomotives of the consist and determines indirect data transmission estimates for the one locomotive based on the received direct data transmission metrics. The processor determines communication paths for the one locomotive by comparing the direct data transmission metrics for the one locomotive to the indirect data transmission estimates for the one locomotive.

In another aspect, the present disclosure is directed to a method of determining communication paths in a trainline communication network including determining direct data transmission metrics for one locomotive of the consist, receiving direct data transmission metrics for remaining locomotives of the consist, and determining indirect data transmission estimates for the one locomotive based on the received direct data transmission metrics for the remaining locomotives of the consist. Communication paths are determined for the one locomotive by comparing the direct data transmission metrics for the one locomotive to the indirect data transmission estimates for the one locomotive.

DETAILED DESCRIPTION

Figure 1:
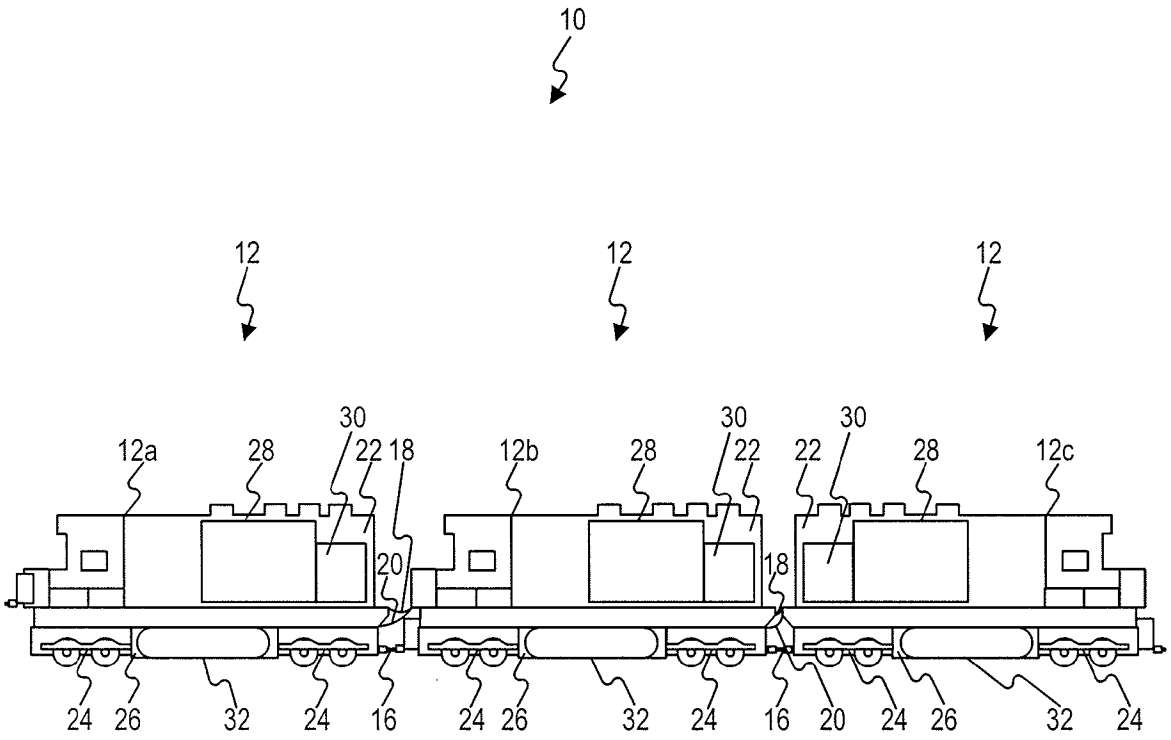
FIG. 1 is a pictorial illustration of an exemplary disclosed consist.

FIG. 1 illustrates an exemplary train consist 10 having one or more locomotives 12. In the disclosed embodiment, consist 10 has three different locomotives 12, including a lead locomotive 12*a* and two trailing locomotives 12*b*, 12*c*. It is contemplated, however, that consist 10 can include any number of locomotives 12 and other cars (e.g. tender cars), and that locomotives 12 can be located in any arrangement and in any orientation (e.g., forward-facing or rear-facing). Consist 10 can be located at the front of a train of other rail vehicles (not shown), within the train of rail vehicles, or at the end of the train of rail vehicles. It is also contemplated that more than one consist 10 can be included within a single train of rail vehicles, if desired, and/or that consist 10 can travel at times without a train of other rail vehicles.

Each locomotive 12 can be connected to an adjacent locomotive 12 in several different ways. For example, locomotives 12 can be connected to each other via a mechanical coupling 16, one or more fluid couplings 18, and one or more electrical couplings 20. Mechanical coupling 16 can be configured to transmit tractive and braking forces between locomotives 12. Fluid couplings 18 may be configured to transmit fluids (e.g., fuel, coolant, lubrication, pressurized air, etc.) between locomotives 12. Electrical couplings 20 can be configured to transmit power and/or data (e.g., data in the form of electrical signals) between locomotives 12. In one example, electrical couplings 20 include an intra-consist electrical cable, such as an MU cable, configured to transmit conventional command signals and/or electrical power. In another example, electrical couplings 20 include a dedicated data link configured to transmit packets of data (e.g., Ethernet data). In yet another example, the data packets can be transmitted via the intra-consist electrical cable. It is also contemplated that some data can be transmitted between locomotives 12 via a combination of the intra-consist electrical cable, the dedicated data link, and/or other means (e.g., wirelessly), if desired.

Each locomotive 12 can include a car body 22 supported at opposing ends by a plurality of trucks 24 (e.g., two trucks 24). Each truck 24 can be configured to engage a track (not shown) via a plurality of wheels, and to support a frame 26 of car body 22. Any number of engines 28 can be mounted to frame 26 within car body 22 and drivingly connected to a generator 30 to produce electricity that propels the wheels of each truck 24. Engines 28 can be internal combustion engines configured to combust a mixture of air and fuel. The fuel can include a liquid fuel (e.g., diesel) provided to engines 28 from a tank 32 located onboard each locomotive 12 or via fluid couplings 18, and/or a blended mixture of the liquid and gaseous fuels.

Figure 2:
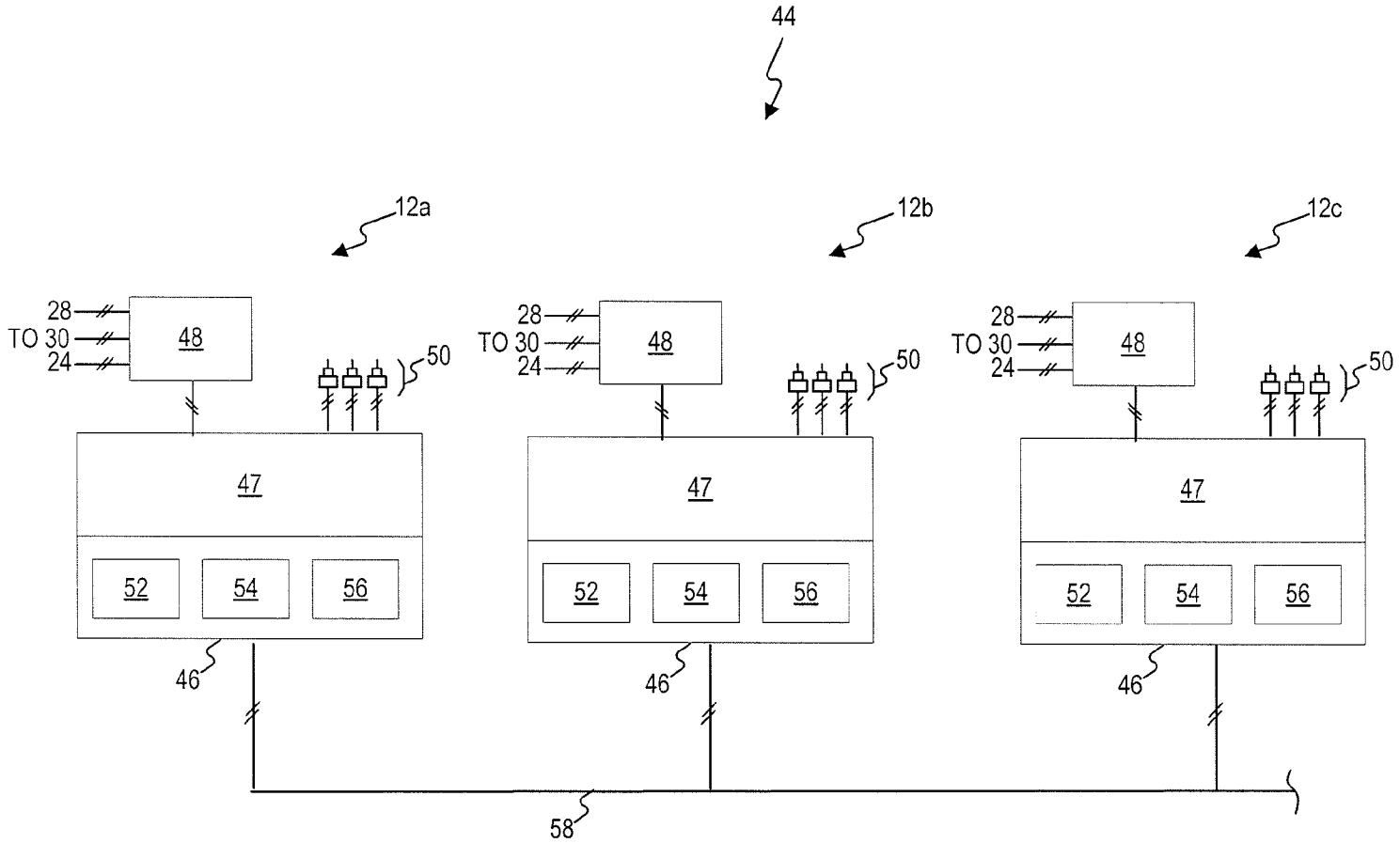
FIG. 2 is a diagrammatic illustration of an exemplary disclosed communication system that may be used in conjunction with the consist of FIG. 1; and, FIG. 3 is a flow chart illustrating an exemplary disclosed method for determining communication paths in a trainline communication network that can be performed by one or more components of the communication system of FIG. 2.

As shown in FIG. 2, consist 10 can be equipped with a communication system 44 that facilitates coordinated control of locomotives 12. Communication system 44 can include, among other things, an access point 46 for each locomotive 12. Each access point 46 can be connected to one or more wired and/or wireless networks, and used to communicate command signals and/or data between controllers 48 of each rail vehicle and various other network components 50 (e.g., sensor, valves, pumps, heat exchangers, accumulators, regulators, actuators, GPS components, etc.) that are used to control locomotives 12. Access points 46 can be connected to each other via electrical couplings 20 (e.g., via the intra-consist electrical cable, via the dedicated data link, and/or wirelessly). Access points 46 can be connected to a local area network hub ("LAN hub") 47 that facilitates communication between the controllers 48, the network components 50, and access points 46.

Each access point 46 can include an inter-consist router ("IC router") 52, an Ethernet bridge 54, and an MU modem 56, as well as conventional computing components known in the art (not shown) such as a processor, input/output (I/O) ports, a storage, and a memory. The I/O ports may facilitate communication between the associated access point 46 and the LAN hub 47. In some embodiments, the I/O ports can facilitate communication between the associated access point 46 and one or more of network components 50.

Likewise, IC router 52 can facilitate communication between different access points 46 of locomotives 12 that are connected to each other via electrical couplings 20. In some embodiments, IC router 52 can provide a proxy IP address corresponding to controllers 48 and network components 50 of remote locomotives. For example, IC router 52 can provide a proxy IP address for one of network components 50 of locomotive 12*b* so controller 48 of locomotive 12*a* can communicate with it. The IC router 52 can include, or be connected to, an Ethernet bridge 54 that can be configured to translate network data to an electrical signal capable of being sent through intra-consist electrical cable 58. Ethernet bridge 54 can include or be connected to MU modem 56. MU modem 56 can be configured to modulate a carrier signal sent over intra-consist electrical cable 58 with the electrical signal received from Ethernet bridge 54 to transmit network data between access points 46. MU modem 56 can also be configured to demodulate signals received from access points 46 and send the demodulated signals to Ethernet bridge 54 for conversion to network data destined to controller 48 or network components 50. In some embodiments, MU modem 56 sends network data orthogonal to data traditionally transmitted over intra-consist electrical cable 58 (e.g., control data). Although FIG. 2 illustrates IC router 52, Ethernet bridge 54, and MU modem 56 as separate components, in some embodiments, one component can perform the functionality of two components. For example, Ethernet bridge 54 may perform the operations described above with respect to IC router 52, or Ethernet bridge 54 can include, or perform the operations of, MU modem 56. Further, for ease of discussion, access point 46 can be discussed as having some or all of the functionality of IC router 52, Ethernet bridge 54, and/or MU modem 56.

In some embodiments, access point 46, IC router 52, Ethernet bridge 54, and/or MU modem 56 can include a processor, storage, and/or memory (not shown). The processor can include one or more processing devices, such as microprocessors and/or embedded controllers. The storage can include volatile or non-volatile, magnetic, semiconductor, tape, optical, removable, non-removable, or other type of computer-readable medium or computer-readable storage device. The storage can be configured to store programs and/or other information that can be used to implement one or more of the processes discussed below. The memory can include one or more storage devices configured to store information.

As described in more detail below, components of access points 46 can be configured to determine the optimal communication paths to transmit data within communication system 44. Access points 46 can use direct communication paths or indirect communication paths. For example, access point 46 of locomotive 12*a* can communicate with access point 46 of locomotive 12*c* either by transmitting data directly to access point 46 of locomotive 12*c* or indirectly by first sending the data to access point 46 of locomotive 12*b*. To facilitate indirect communication, the components of access points 46 can be configured to store and forward data to other access points 46 that are in the consist. For example, when access point 46 of locomotive 12*b* receives data with instructions to forward the data to access point 46 of locomotive 12*c*, it can store the data in local memory, and then send the data to access point 46 of locomotive 12*c*. The store and forward functionality can be included in IC router 52, Ethernet bridge 54, or MU modem 56. In some embodiments, access points 46 of communication system 44 can stream-forward the data bits of a data packet or message as they are received, as opposed to waiting until the entire data packet or message is received. The stream-forward functionality can be included in IC router 52, Ethernet bridge 54, or MU modem 56. The operations that can be performed by access point 46 or its components to determine communication paths is discussed below in greater detail with respect to FIG. 3.

Each controller 48 can be configured to control operational aspects of its related rail vehicle. For example, controller 48 of lead locomotive 12*a* can be configured to control operational aspects of its corresponding engine 28, generator 30, traction motors, operator displays, and other associated components. Likewise, the controllers 48 of trail locomotives 12*b* and 12*c* can be configured to control operational aspects of their corresponding engines 28, generators 30, traction motors, operator displays, and other associated components. In some embodiments, controller 48 of lead locomotive can be further configured to control operational aspects of trail locomotives 12*b* and 12*c*, if desired. For example, controller 48 of lead locomotive 12*a* can send commands through its access point 46 to the access points of trail locomotives 12*b* and 12*c*.

Each controller 48 can embody a single microprocessor or multiple microprocessors that include a means for controlling an operation of the associated rail vehicle based on information obtained from any number of network components 50 and/or communications received via access points 46. Numerous commercially available microprocessors can be configured to perform the functions of controller 48. Controller 48 can include a memory, a secondary storage device, a processor, and any other components for running an application. Various other circuits may be associated with controller 48 such as power supply circuitry, signal conditioning circuitry, solenoid driver circuitry, and other types of circuitry.

The information obtained by a particular controller 48 via access points 46 and/or network components 50 can include performance related data associated with operations of each locomotive 12 ("operational information"). For example, the operational information can include engine related parameters (e.g., speeds, temperatures, pressures, flow rates, etc.), generator related parameters (e.g., speeds, temperatures, voltages, currents, etc.), operator related parameters (e.g., desired speeds, desired fuel settings, locations, destinations, braking, etc.), liquid fuel related parameters (e.g., temperatures, consumption rates, fuel levels, demand, etc.), gaseous fuel related parameters (e.g., temperatures, supply rates, fuel levels, etc.), and other parameters known in the art.

The information obtained by a particular controller 48 via access points 46 and/or network components 50 can also include identification data of the other rail vehicles within the same consist 10. For example, each controller 48 can include stored in its memory the identification of the particular rail vehicle with which controller 48 is associated. The identification data can include, among other things, a type of rail vehicle (e.g., make, model, and unique identification number), physical attributes of the associated rail vehicle (e.g., size, load limit, volume, power output, power requirements, fuel consumption capacity, fuel supply capacity, etc.), and maintenance information (e.g., maintenance history, time until next scheduled maintenance, usage history, etc.). When coupled with other rail vehicles within a particular consist 10, each controller 48 can be configured to communicate the identification data to the other controllers 48 within the same consist 10. Each controller 48, can be configured to selectively affect operation of its own rail vehicle based on the obtained identification data associated with the other rail vehicles of consist 10.

In some embodiments, controllers 48 can be configured to affect operation of their associated rail vehicles based on the information obtained via access points 46 and/or network components 50 and one or more maps stored in memory. Each of these maps may include a collection of data in the form of tables, graphs, and/or equations. Controllers 48 can be configured to affect operation of their associated locomotives based on the position within a locomotive consist. The position of the locomotive associated with controller 48 can be used with the one or more maps to control the operation of the locomotive. For example, a map of throttle settings can be stored in the memory of controller 48. The map of throttle settings can include a mapping of consist position to throttle setting. For example, when the locomotive of controller 48 is the lead locomotive (e.g., in first position in the consist) the map may indicate that controller 48 should set the throttle to Notch 4, and when the locomotive of controller 48 is the third trail locomotive (e.g., in fourth position in the consist), the map may indicate that controller 48 should set the throttle to Notch 2.

INDUSTRIAL APPLICABILITY

The disclosed system for determining communication paths in a trainline communication network may be applicable to any consist that includes a plurality of rail cars, such as locomotives. The disclosed system can provide increased performance because it is capable of determining the optimal communication path between the locomotives in a consist, which is not necessarily a direct communication path. The operation of the system for determining communication paths in a trainline communication network will now be explained.

Figure 3:
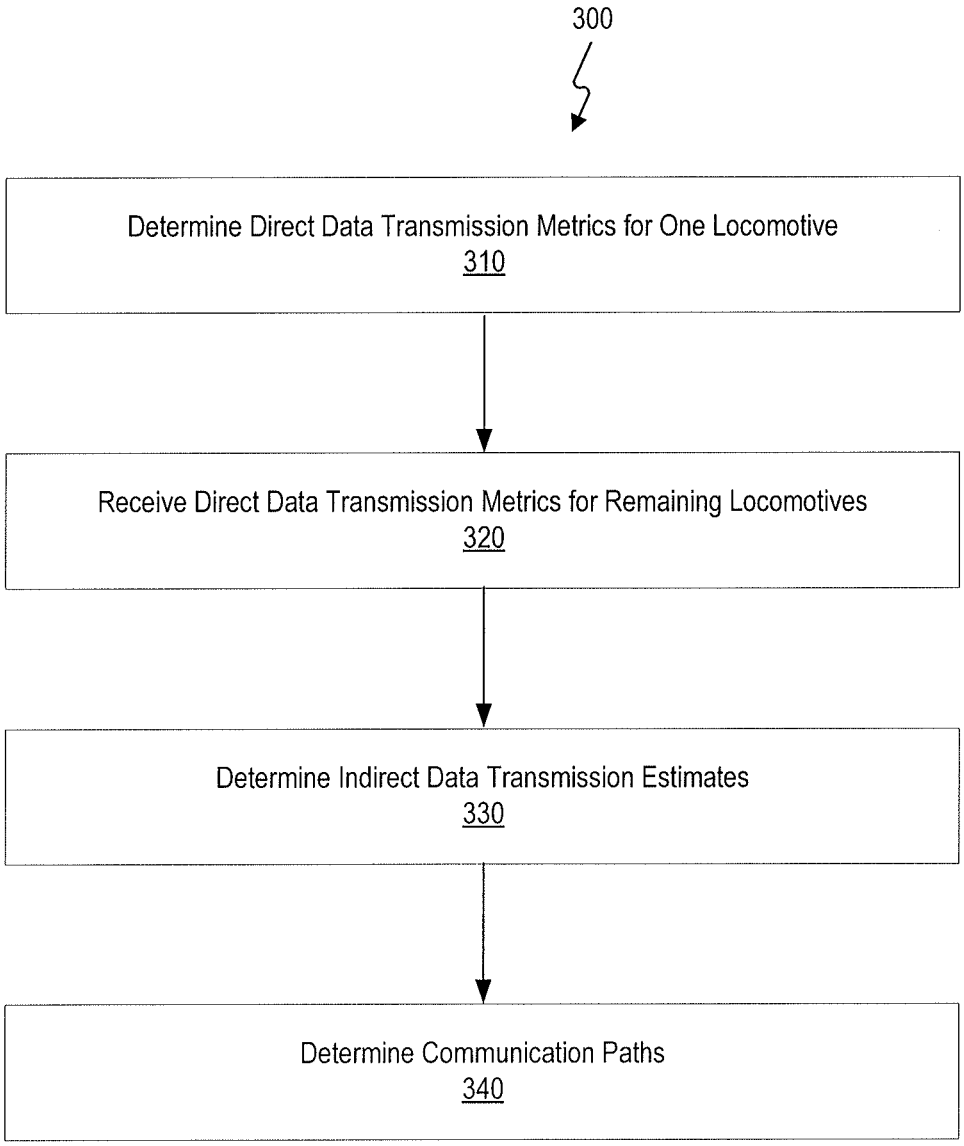

FIG. 3 is a flowchart illustrating a method 300 that can be performed by one or more components of locomotive 12. During the operation of consist 10, controller 48, access point 46, one of the components of access point 46, or one of network components 50 can perform method 300 to determine communication paths between locomotives within a consist. Although any one of controller 48, access point 46, components of access point 46, or network components 50 can perform method 300, for ease of discussion, method 300 will be described as being performed by IC router 52.

IC router 52 begins method 300 by determining direct data transmission metrics for one locomotive (step 310), for example, IC router's 52 associated locomotive. The determined direct data transmission metrics can be capable of quantifying the quality of the direct communication path between the locomotive of IC router 52 and the other locomotives of consist 10. For example, when IC router 52 of locomotive 12*a* is performing method 300, the direct data transmission metrics can quantify the quality of the direct communication path between access point 46 of locomotive 12*a* and the access points 46 of locomotive 12*b* and locomotive 12*c*. The direct data transmission metrics can include a data transmission measurement obtained by sending and receiving a standardized data packet between the access points 46 of consist 10. For example, IC router 52 can start a timer, send a standardized packet to each access point 46 requesting a reply message and stop the timer when the request is received. The transmission time for each access point 46 of consist 10 can be included in the direct data transmission metrics. In some embodiments, IC router 52 is configured to calculate a data rate for the messages it typically sends through access point 46. For example, when a control message is sent from the access point 46 of locomotive 12*a* to the access point 46 of locomotive 12*b*, IC router 52 can record the amount of time it took to receive an acknowledgement from access point 46 of locomotive 12*b*, and determine a data rate based on the size of the control message. As access point 46 of locomotive 12*a* continues to send messages to access point 46 of locomotive 12*b*, IC router 52 can calculate an average data rate, such as the average number of kilobits per second (kbit/s).

As described above, data can be modulated and sent over intra-consist electrical cable 58 based on one or more carrier frequencies. In some embodiments, access point 46 can use multiple frequencies, and each frequency can offer a different throughput for data. IC router 52 can refer to a tone map that indicates what frequencies access point 46 uses for communication system 44. The tone map, for example, can be used by MU modem 56 to determine what carrier frequencies MU modem 56 uses to modulate data that is to be sent over intra-consist electrical cable 58. According to some embodiments, the tone map further includes data rates for each frequency and IC router 52 can write to the tone map the data rates for each frequency used. Additionally, or alternatively, IC router 52 can maintain a data structure that includes data rates for the frequencies of the tone map. As access point 46 sends and receives messages over communication system 44, IC router 52 can update the data rates associated with the frequencies of the tone map. When IC router 52 performs method 300, it can refer to the tone map, or the data structure associating date rates with frequencies in the tone map, to determine direct data transmission metrics for one locomotive. In some embodiments, IC router 52 can obtain a summary of the transmission data in the tone map. The summary can include the sum of the data rates for each frequency in the tone map.

IC router 52 can also determine a direct data transmission metric for the length of time it would take to transmit a block of data based on data rates from the tone map, calculated data rates, or transmission times for sending and receiving a standardized data packet as described above. For example, when IC router 52 determines a direct data transmission metric specifying the amount of time it takes to transmit 1,000 bits (1 kbit), it can covert data rates to seconds by taking the reciprocal of the data rate. For example, when IC router determines that the data rate between access point 46 of locomotive 12*a* and access point 46 of locomotive 12*b* is 5,000 kbits/s, it can determine a direct data transmission metric of 0.0002 s, which specifies the amount of time it takes to transmit 1 kbit from access point 46 of locomotive 12*a* to access point 46 of locomotive 12*b*.

Once IC router 52 determines direct data transmission metrics for one locomotive of a consist, it can receive direct data transmission metrics for the remaining locomotives of the consist (step 320). In some embodiments, the IC routers 52 of the remaining locomotives of the consist can determine direct data transmission metrics for their associated locomotives in a manner similar to that described above with respect to step 310. For example, IC router 52 of locomotive 12*b* and IC router 52 of locomotive 12*c* can perform the operations of step 310 to determine direct data transmission metrics for locomotive 12*b* and locomotive 12*c*. In some embodiments, IC routers 52 of the locomotives of consist 10 periodically send the direct data transmission metrics for their respective locomotives to each other. For example, when IC router 52 of locomotive 12*a* is performing method 300, the IC routers 52 of locomotive 12*b* and locomotive 12*c* can periodically (e.g., every five minutes) send direct data transmission metrics to IC router 52 of locomotive 12*a*. One IC router 52 of consist 10 can also request that the other IC routers 52 of consist 10 send it their current direct data transmission metrics. For example, as IC router 52 performs the operations of method 300, it can broadcast a request to all IC routers 52 of consist 10 requesting that each send its tone map summary or average data rate.

Once IC router 52 receives the direct data transmission metrics associated with the other locomotives of consist 10, it can determine indirect data transmission estimates using them (step 330). IC router 52 can determine indirect data transmission estimates for each access point 46 of consist 10. For example, IC router 52 of locomotive 12*a* can determine an indirect data transmission estimate for communicating to access point 46 of locomotive 12*c* through access point 46 of locomotive 12*b*, that is, an estimate of sending a data transmission first to access point 46 of locomotive 12*b* with a command for access point 46 of locomotive 12*b* to repeat or forward the data transmission to access point 46 of locomotive 12*c*. In some embodiments, the indirect data transmission estimate can include overhead time that may be needed to forward data transmissions. For example, when forward operations take 0.025 seconds, IC router 52 can include 0.025 seconds of additional time in its estimates for each access point 46 needed to complete an indirect communication.

After IC router 52 determines the indirect data transmission estimates, it can determine communication paths from its associated locomotive to the access points 46 of the other locomotives within in the consist (step 340). IC router 52 can compare the indirect data transmission estimates to communicate with all of the locomotives in the consist to the direct data transmission metrics to determine the communication path that yields the fastest transmission time. For example, IC router of locomotive 12*a* can compare the direct data transmission metric for sending data directly to access point 46 of locomotive 12*b* to the indirect data transmission estimate for sending data indirectly to access point 46 of locomotive 12*b* by first sending the data to access point 46 of locomotive 12*c*. IC router 52 of locomotive 12*a* can also compare the direct data transmission metric for sending data directly to access point 46 of locomotive 12*c* to the indirect data transmission estimate for sending data indirectly to access point 46 of locomotive 12*c* by first sending the data to access point 46 of locomotive 12*b*.

Once IC router 52 determines the optimal communication path (e.g., based on speed of transmission), IC router 52 can send communications to access points 46 of consist 10 according to the determined optimal communication paths. For example, when IC router 52 of locomotive 12*a* determines that the optimal communication path to access point 46 of locomotive 12*b* is to send data directly to access point 46 of locomotive 12*b*, it can send data directly to access point 46 of locomotive 12*b*. When IC router 52 of locomotive 12*a* determines that the optimal communication path to access point 46 of locomotive 12*c* is to send data indirectly by first sending it to access point 46 of locomotive 12*b*, it can send data indirectly to access point 46 of locomotive 12*c* by first sending the data to access point 46 of locomotive 12*b* with instructions to forward the data to access point 46 of locomotive 12*c*.

The following non-limiting example illustrates an example of IC router 52 performing the operations of method 300 to determine communication paths between its associated locomotive and the access points of other locomotives of a consist. IC router 52 can be associated with a lead locomotive, A, in a four locomotive consist. The four locomotive consist further includes three trail locomotives, B, C, and D. Each of the three trail locomotives is associated with an IC router capable of determining direct data transmission metrics for its respective trail locomotive. Consistent with the with the discussion above for step 310, IC router 52 can determine the following direct data transmission metrics (expressed in seconds to transmit 10 kbits of data) for A:

| From | To | Time |
|---|---|---|
| A | B | .150 |
| A | C | .329 |
| A | D | 0.965 |

IC router 52 receives the following direct data transmission metrics for locomotives B, C, and D:

| From | To | Time |
|---|---|---|
| B | C | .162 |
| B | D | .345 |
| C | D | .186 |

IC router 52 can then calculate the following indirect data transmission estimates based on the received direct data transmission metrics for locomotives B, C, and D, including 0.095 seconds of overhead for forwarding the signal:

| Communication Path | # of forwards | Overhead | Estimate |
|---|---|---|---|
| A → B → C | 1 | .095 | .150 + .162 + .02 = .332 |
| A → C → D | 1 | .095 | .329 + .186 + .085 = 0.6 |
| A → B → C → D | 2 | .190 | .150 + .162 + .186 + .190 = 0.688 |

Based on the above estimates, IC router 52 can determine the following communication paths for sending messages to each of the access points associated with locomotives B, C, and D:

| From | To | Path |
|---|---|---|
| A | B | A → B (direct) |
| A | C | A → C (direct) |
| A | D | A → C → D (indirect) |

IC router 52 can send one or more data transmission to the access points of locomotives B, C, and D according to the communication paths outlined in the table above. IC router 52 can perform the operations of method 300 periodically so that it continues to use the best communication paths for communicating with access points B, C, and D. It should be apparent that one with skill in the art will recognize that although the above example includes optimal routes that were all in the forward direction, in some embodiments, the optimal communication path can include sending data backward. For example, IC router 52 may determine that the optimal communication path to send a data transmission to locomotive B is to first sent the data transmission to locomotive C, which then forwards the data transmission to B.

Several advantages over the prior art may be associated with the system for determining communication paths in a trainline communication network. The disclosed system may provide increased performance as it can utilize both direct and indirect communication paths to communicate data between locomotives. The system is capable of determining the speed of multiple communication paths between locomotives in a consist and using the quickest of those communication paths for sending data, thereby realizing increased performance over the systems of the prior art.

It will be apparent to those skilled in the art that various modifications and variations can be made to the system for determining communication paths in a trainline communication network. Other embodiments will be apparent to those skilled in the art from consideration of the specification and practice of the disclosed system for determining communication paths in a trainline communication network. It is intended that the specification and examples be considered as exemplary only, with a true scope being indicated by the following claims and their equivalents.

What is claimed is:

1. A system for determining communication paths in a trainline communication network utilized by a consist, the system comprising:

a processor configured to:

determine direct data transmission metrics for one locomotive of the consist;

receive direct data transmission metrics based on one or more tone maps for the remaining locomotives of the consist, wherein the one or more tone maps comprise data rate and frequency information;

determine indirect data transmission estimates for the one locomotive based on the received direct data transmission metrics for the remaining locomotives of the consist;

determine communication paths for the one locomotive by comparing the direct data transmission metrics for the one locomotive to the indirect data transmission estimates for the one locomotive; and send a data transmission to one of the remaining locomotives according to the determined communication paths.

2. The system of claim 1 wherein the processor is configured to determine communication paths for the one locomotive periodically.

3. The system of claim 1 wherein the direct transmission metrics for the one locomotive and the remaining locomotives in the consist include transmission data rates.

4. The system of claim 1 wherein the one or more tone maps of the remaining locomotives include data rate information for each frequency in the tone map.

5. The system of claim 1 wherein the trainline communication network includes intra-consist electrical cables.

6. The system of claim 1 wherein the trainline communication network includes a wireless communication network.

7. The system of claim 1 wherein the processor is further configured to communicate the direct data transmission metrics for the one locomotive of the consist to the remaining locomotives of the consist.

8. The system of claim 1 wherein the processor is part of a router disposed on the one locomotive.

9. A method for determining communication paths in a trainline communication network utilized by a consist, the method comprising:

determining, by a processor, data transmission metrics for one locomotive of the consist;

receiving, in the processor, direct data transmission metrics based on one or more tone maps for remaining locomotives of the consist, wherein the one or more tone maps comprise data rate and frequency information;

determining, by the processor, indirect data transmission estimates for the one locomotive based on the received direct data transmission metrics for the remaining locomotives of the consist;

determining, by the processor, communication paths for the one locomotive by comparing the direct data transmission metrics for the one locomotive to the indirect data transmission estimates for the one locomotive; and sending, by the processor, a data transmission from the one locomotive to one of the remaining locomotives of the consist according to the determined communication paths.

10. The method of claim 9 wherein the method is performed by at least one locomotive of the consist on a periodic basis.

11. The method of claim 9 wherein the direct transmission metrics for the one locomotive of the consist and the remaining locomotives of the consist include transmission data rates.

12. The method of claim 9 wherein the one or more tone maps associated with the remaining locomotives of the consist include data rate information for each frequency in the tone map.

13. The method of claim 9 wherein the processor is part of a router disposed on each locomotive of the consist.

14. The method of claim 9 wherein the communication network includes intra-consist electrical cables.

15. The method of claim 9 wherein the communication network includes a wireless communication network.

16. The method of claim 9 further including communicating the direct data transmission metrics for the one locomotive of the consist to the remaining locomotives of the consist.

17. A locomotive consist comprising:

a first locomotive;

a plurality of remaining locomotives, each of the plurality of remaining locomotives including a processor configured to determine direct data transmission metrics associated with its respective locomotive;

a plurality of intra-consist electrical cables a communication network configured to communicate network over the plurality of intra-consist electrical cables;

a first processor associated with the first locomotive, the first processor configured to:

determine first direct data transmission metrics for the first locomotive of the consist;

receive the direct data transmission metrics based on one or more tone maps associated with the plurality of remaining locomotives of the consist, wherein the one or more tone maps comprise data rate and frequency information;

determine indirect data transmission estimates for the first locomotive based on the received direct data transmission metrics associated with the plurality of remaining locomotives of the consist;

determine communication paths for the first locomotive by comparing the first direct data transmission metrics for the first locomotive to the indirect data transmission estimates for the first locomotive; and send a data transmission from the first locomotive to one of the plurality of remaining locomotives of the consist according to the determined communication paths.

* * * * *